United States Patent [19]

Desrosiers et al.

[11] 4,091,496

[45] May 30, 1978

[54] VACUUM CLEANER NOZZLE

[76] Inventors: Wilfrid Desrosiers, 6 Cournoyer Street; Jean-Marc Landry, 11 Kennedy Street, both of Kapuskasing, Ontario, Canada

[21] Appl. No.: 626,026

[22] Filed: Oct. 28, 1975

[51] Int. Cl.[2] ..... A47L 9/06

[52] U.S. Cl. ..... 15/371; 15/421

[58] Field of Search ..... 15/371, 398, 415, 420, 15/421, 400

[56] References Cited

U.S. PATENT DOCUMENTS

| | | | |
|---|---|---|---|
| 1,013,606 | 1/1912 | MacLean | 15/371 X |
| 1,060,191 | 4/1913 | Kent | 15/421 |
| 1,099,141 | 6/1914 | Kent | 15/421 |
| 1,823,542 | 9/1931 | Hertz | 15/421 X |
| 1,985,849 | 12/1934 | Allen | 15/421 X |
| 2,181,594 | 11/1939 | Björkman | 15/421 X |
| 2,276,943 | 3/1942 | Dow | 15/400 X |
| 2,349,371 | 5/1944 | Patterson | 15/400 X |
| 3,102,289 | 9/1963 | Norris | 15/421 X |
| 3,550,183 | 12/1970 | Wolf | 15/420 X |

*Primary Examiner*—Christopher K. Moore

[57] ABSTRACT

A vacuum cleaner nozzle particularly adapted to clean carpets and characterized by its efficient combination of central brushing and downward and inward air flows on opposite sides and toward the central brush and also characterized by selective height setting in relation to the length of the hairs of a carpet. This vacuum cleaner nozzle includes a central body defining an air suction chamber, a rim engaging around the central body and cooperatively forming therewith a pair of downwardly extending slots laterally communicating with the central suction chamber under the nozzle, these slots extending against the laterally opposite sides of the central body, and the rim being settable relative to the latter in relation to the length of the hairs of any carpet.

2 Claims, 11 Drawing Figures

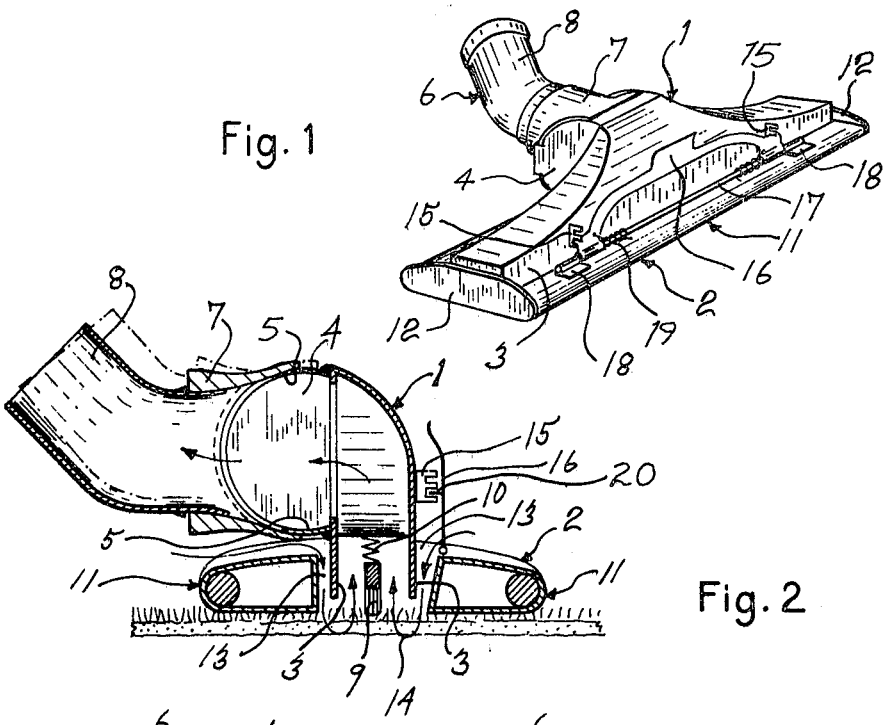
Fig. 1
Fig. 2
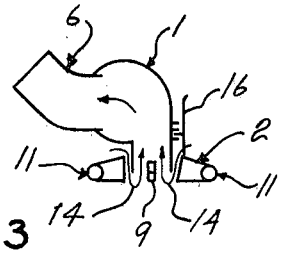
Fig.3
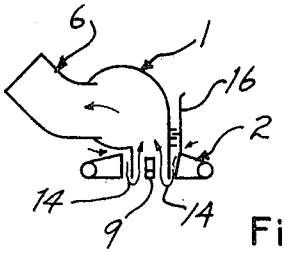
Fig.4
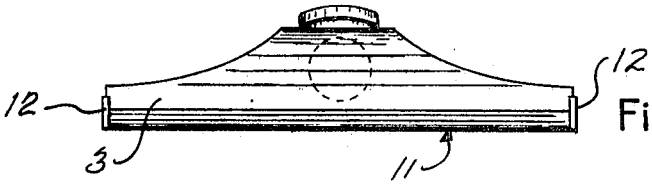
Fig.5
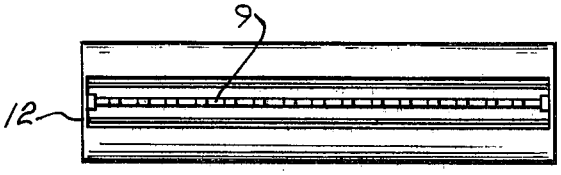
Fig.6

VACUUM CLEANER NOZZLE

This invention relates to a nozzle for a vacuum cleaner, and more particularly, to a vacuum cleaner nozzle of the type particularly adapted to clean rugs or carpets.

The rugs or carpets are now currently made with hairs of varying lengths. The vacuum cleaning of the carpets is affected by the length of the hairs and, consequently, a conventional vacuum cleaner nozzle does not clean with the same efficiency a carpet with short hairs and a carpet with long hairs.

It is a general object of the present invention to provide a vacuum cleaning nozzle of the above type which is adjustable according to the length of the hairs of any carpet, such as to more efficiently clean any carpet irrespective of the length of the hairs thereof.

It is another object of the present invention to provide a vacuum cleaning nozzle of the above type which effectively combines brushing and air jet flows for optimum cleaning action around the hairs of a carpet irrespective of the length of these hairs.

It is a more specific object of the present invention to provide a vacuum cleaning nozzle which is formed of a central body and a rim settable around the latter to form air inlet apertures downwardly projecting against laterally opposite sides of the central body and communicating with the air suction chamber of the latter under the nozzle, such that the height of the central body is set in relation to the length of the hairs of a carpet for efficient lateral air flows around these hairs.

It is a further more specific object of the present invention to provide a vacuum cleaner nozzle of the above type wherein a brush is centrally mounted under the latter and air inlet apertures project downwardly through the nozzle on opposite sides of the brush and of the air suction chamber for most efficient central brushing action and inward air flows equally from both sides toward the brush.

The above and other objects and advantages of the present invention will be better understood with the following detailed description of preferred embodiments thereof which are illustrated, by way of example, in the accompanying drawings, wherein:

FIG. 1 is a perspective view of a vacuum cleaner nozzle according to a first embodiment of the present invention;

FIG. 2 is a cross-sectional view taken transversely through the center of the nozzle of FIG. 1;

FIGS. 3 and 4 are schematic views corresponding to FIG. 2 and illustrating long hairs and short hairs settings respectively of the rim relative to the central body;

FIG. 5 is a front view of the vacuum cleaner nozzle of the preceding Figures;

FIG. 6 is a bottom view of the same vacuum cleaner nozzle;

Figures 7, 8, 9, 10, 11:
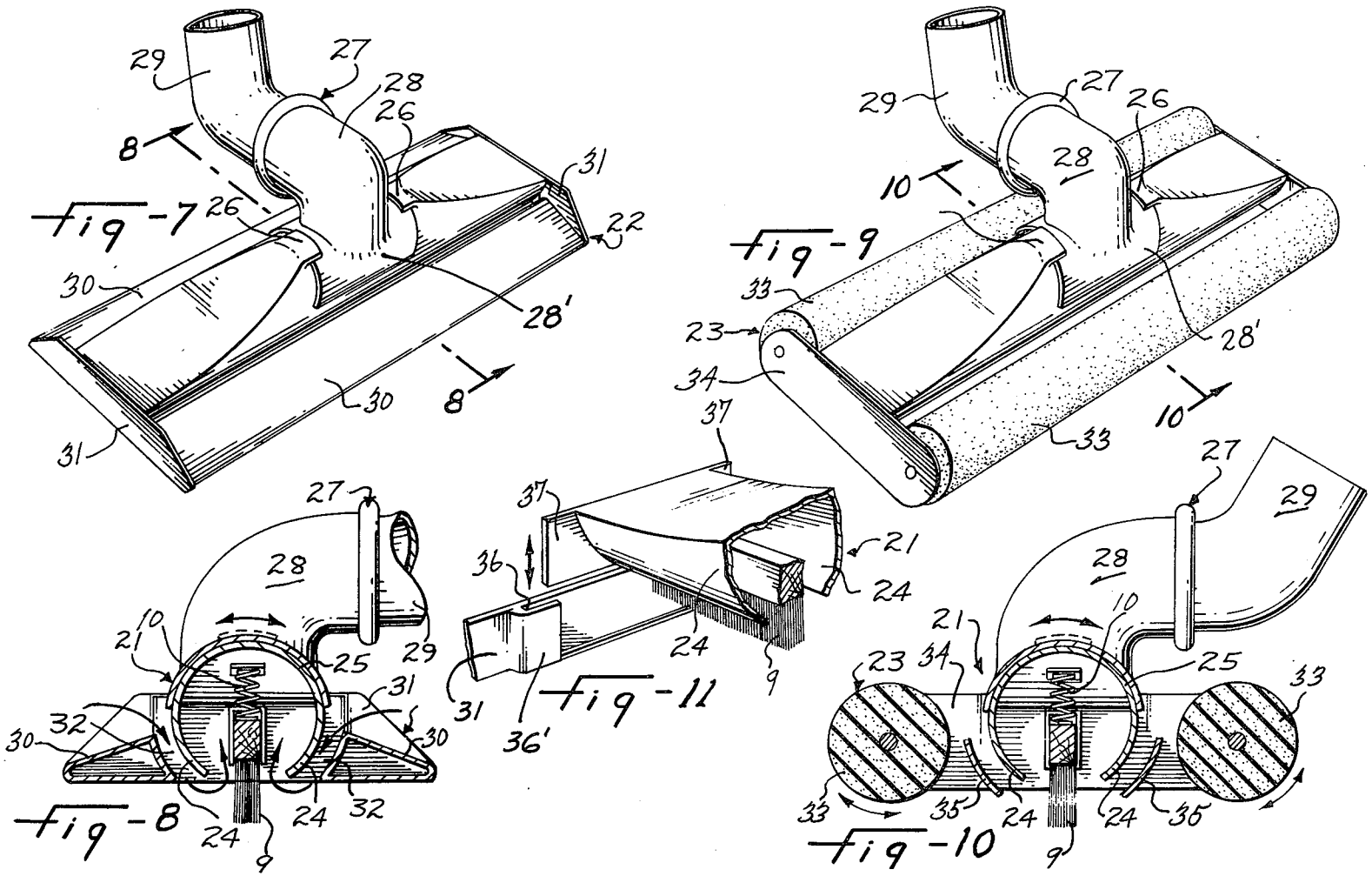
FIG. 7 is a perspective view of a vacuum cleaner nozzle according to a second embodiment of the invention and provided with a rim for short hairs.
FIG. 8 is a cross-sectional view as seen along line 8—8 in FIG. 7.
FIG. 9 is a perspective view of a vacuum cleaner nozzle still according to the second embodiment but provided with a rim for long hairs.
FIG. 10 is a cross-sectional view as seen along line 10—10 in FIG. 9.
FIG. 11 is a partial perspective view of the vacuum cleaner nozzle according to the second embodiment particularly illustrating removable connection of either rim to the central body.

The vacuum cleaner nozzle according to the first embodiment of the invention, illustrated in FIGS. 1 to 6 inclusive, comprises a suction head including a central body 1 and a rim 2. The central body 1 forms an elongated casing having a pair of opposite front and rear sides 3 defining an elongated suction mouth between them. The elongated casing also includes a pair of spaced-apart ears 4 and coaxial cylindrical portions 5 extending transversely between these ears and defining a central outlet with the latter. The elongated casing encloses a central vacuum chamber communicating with the elongated suction mouth and with the central outlet. A swivel coupling 6 is connected to the elongated casing and includes a first section 7 pivotally engaged over the cylindrical portions 5 and a second section 8 swivelly engaging this first section.

An elongated brush 9 is centrally mounted intermediate the front and rear sides 3 and is outwardly biased by springs 10 for engagement of the brush with the underlying carpet.

The rim 2 forms a rectangular frame defining an elongated opening therethrough for fitting the central body 1 therein. The rim 2 has spaced-apart lateral edge portions 11 coupled together at the opposite ends by end plates 12. The edge portions 11 extend along the front and rear sides 3 and are outwardly spaced from the latter to form a pair of slots 13 against the outside of the laterally opposite sides 3. These slots 13 form air inlet apertures allowing the air to flow downwardly therethrough and thereafter laterally inwardly under the nozzle and upwardly in the air suction mouth formed between the sides 3, as shown by the arrows 14 in FIGS. 2, 3, and 4.

A pair of notched brackets 15 are fixedly secured against the front of the central body 1. A latch member 16 is pivoted on the front edge portion 11 of the rim 2 by a rod 17 held by brackets 18. Spring wires 19 are coiled around the rod 17 and bias the latch member 16 toward engagement of the projections 20 in a selected notch of each notched bracket 18. Thus, the height of the rim 2 relative to the central body 1 is set as desired by selective engagement of the latch member 16 with a notch of each notched bracket 15. This height setting may be done in relation to the length of the hairs of the carpet, such that the longer are the hairs, the higher is set the central body 1 relative to the rim 2.

The air flow indicated by the arrows 14 has similarly effective sweeping action irrespective of the length of the hairs.

In the second embodiment of the invention illustrated in FIGS. 7 to 11 inclusive, the vacuum cleaner nozzle comprises a suction head including a central body 21 cooperatively engageable with either a rim 22 or a rim 23.

The central body 21 forms an elongated casing having end walls 37 and a pair of opposite front and rear sides 24 defining an elongated suction mouth between them. End Walls 37 project outwardly from sides 24 to define free standing tongues. The elongated casing also includes a central portion having a cylindrical outside wall 25 and holding lugs 26 overlying the outside wall 25. The cylindrical outside wall 25 has a central outlet aperture therethrough. The elongated casing encloses a central vacuum chamber communicating with the elongated suction mouth and with the central outlet. A tubular swivel coupling 27 is connected to the elongated casing and includes a first section 28 having an inlet aperture surrounded by a semi-cylindrical flange 28' pivotally and slidably engaged over the cylindrical outside wall 25 and a second section 29 swivelly engaging this first section. Lugs 26 overly flange 28' on opposite sides thereof to retain the latter in slidable contact with outside wall 25.

This central body 21 is also provided with an elongated brush 9 and springs 10, arranged centrally between the sides 24.

The rim 22, as shown in FIGS. 7 and 8, forms a rectangular frame defining an elongated opening therethrough for fitting the central body 21 therein. The rim 22 has spaced-apart lateral edge portions 30 coupled together at the opposite ends by end plates 31. The edge portions 30 extend along the front and rear sides 24 and are outwardly spaced from the latter to form a pair of slots 32 comparable to the slots 13.

The rim 23, as shown in FIGS. 9 and 10, forms also a rectangular frame defining an elongated opening therethrough for fitting the central body 21 therein. The rim 23 has spaced-apart lateral edge portions formed by rollers 33 rotatably carried at opposite ends by end plates 34. Strips 35 interconnect the end plates 34 between each side wall 24 and the adjacent roller 33. The edge portions formed by the rollers 33 extend along the front and rear sides 24 and are outwardly spaced from the latter to form a pair of slots comparable to the slots 13 and 32.

The rims 22 and 23 may be selectively connected and removed from the central body 21 and are thus interchangeable one for the other. To that effect, the end plates 31 and 34 are each formed at their inside face with grooves 36 defined by lugs 36' for removable insertion of the tongues 37 at each end of the elongated casing.

The rim 22 of FIGS. 7 and 8 is for a carpet or rug having from about medium to long hairs, while the rim 23 of FIGS. 9 and 10 is for a carpet or rug having shorter hairs or for sweeping hard-surfaced floors, such as tiles, linoleum, etc.

What we claim is:

1. A vacuum cleaner nozzle comprising an elongated hollow body portion and a rim surrounding said body portion and removably attached to the latter, said body portion defining a vacuum chamber therein and having a suction mouth extending longitudinally of its underside, said body portion having a middle section with an outside wall of circular cross-sectional shape and having an outlet opening, a swivel tubular coupling for connecting, through said opening, the vacuum chamber to a vacuum source, and including an inlet opening surrounded by a substantially semi-cylindrical flange slidably fitted over said cylindrical outside wall around said outlet opening for swinging slidable movement of said tubular section around said outside wall, holding lugs projecting from said outside wall and overlying opposite sides of said flange to retain the latter in slidable contact with said outside wall, said hollow body portion having end walls closing the ends thereof, each end wall having co-planar tongues projecting from the front and rear thereof, said rim including end plates and a pair of lateral edge portions rigidly interconnecting said end plates, said end plates applied against the outside of said end walls, lugs projecting from the inside face of said end plates and forming grooves with said end plates, said grooves being sized to slidably receive said tongues, whereby said body portion has a removable slidable connection with said rim at both ends of said body and rim, said rim forming a unitary assembly with said body pivotable as a whole relative to said coupling by relative slidable movement of said flange on said outside wall, said lateral edge portions extending parallel to, and equally spaced from, the sides of said body portion over the entire length thereof on opposite sides of said mouth to define with said sides elongated air inlet slots extending longitudinally of said body portion and directed towards said mouth.

2. A vacuum cleaner nozzle as claimed in claim 1, further including an elongated brush extending longitudinally within said hollow body portion with the brush bristles protruding downwardly through said mouth, said brush carried by said end walls for guided advancing and retracting movement through said mouth and spring loaded to an advanced position.

* * * * *